United States Patent [19]

McCann

[11] Patent Number: 4,581,868

[45] Date of Patent: Apr. 15, 1986

[54] GLASS ASSEMBLY

[75] Inventor: James D. McCann, Standish, Nr. Wigan, England

[73] Assignee: Pilkington Brothers P.L.C., St. Helens, Merseyside, England

[21] Appl. No.: 647,457

[22] Filed: Sep. 5, 1984

[30] Foreign Application Priority Data

Sep. 12, 1983 [GB] United Kingdom ..... 8324355

[51] Int. Cl.[4] ..... E04C 2/54

[52] U.S. Cl. ..... 52/398; 52/235; 52/304; 52/403; 52/788

[58] Field of Search ..... 52/235, 304, 483, 771, 52/398, 509, 788, , 403, 200; 428/34; 156/109

[56] References Cited

U.S. PATENT DOCUMENTS 2,239,545 4/1941 Aull, Jr. et al. ..... 52/396 X 2,302,740 11/1942 Boicey ..... 52/304

2,834,998 5/1958 Wilder ..... 52/403 X 4,428,169 1/1984 Tsakiris ..... 52/200

4,500,572 2/1985 Francis ..... 52/304 X

FOREIGN PATENT DOCUMENTS 24857 3/1981 European Pat. Off. ..... 52/235

*Primary Examiner*—Alfred C. Perham

*Assistant Examiner*—Jean M. LaKemper

*Attorney, Agent, or Firm*—Burns, Doane, Swecker & Mathis

[57] ABSTRACT

A glass assembly for forming a wall or roof-light, comprises a planar array of sealed multiple glazing units which are secured to supporting members by mechanical fixings which pass through the outer glass sheets of the units outside the seals of the units. The outer glass sheets are sealed edge-to-edge.

10 Claims, 5 Drawing Figures

GLASS ASSEMBLY

This invention relates to a glass assembly, for example an assembly for forming a wall or a roof light of a building.

Glass wall assemblies are known, such as suspended glass wall assemblies, in which adjacent glass sheets are secured together by fixing to holder patch plates which are themselves secured to structural members of a building. Usually there is a patch plate at each junction of four corners of adjacent sheets which patch plates are visible from the outside of the building, and the spaces between the edges of the sheets are sealed using a silicone sealant. One such assembly is described in European Patent Publication No. 0024857, in which assembly provision is made for flexible fixing of the patch plates to vertical stabilising glass fins or frame members of a building structure.

Single glazed glass wall assemblies have been constructed in which glass panes are fixed in a planar array edge-to-edge, with their corners secured to frame members of a building structure by bolts which pass from the outside through countersunk holes at corners of the sheets. The gaps between the panes are sealed with a silicone sealant.

Double glazed glass wall assemblies are also known, in which sealed double glazing units are fixed edge-to-edge in a planar array, with the gaps between the units sealed with a silicone sealant. However, the units have been fastened to the supporting structure by adhesive because of the difficulty of securing the units mechanically without detracting from the uninterrupted planar appearance of the outside of the assembly.

It is a main object of the present invention to provide a new glass assembly for use for example as a wall or roof light, in which the assembly is constructed from sealed multiple glazing units which are mechanically secured to supporting members without detracting from the uninterrupted planar appearance of the outside of the assembly.

SUMMARY

Accordingly the invention provides a glass assembly comprising a planar array of sealed multiple glazing units each comprising two opposed spaced sheets with a seal between the sheets defining a sealed gas space therewith, which units are secured to supporting members with the outer sheets of the units sealed edge-to-edge, at least some of the units being secured to the supporting members by mechanical fixings passing through the outer sheets of the units outside the seals of the units.

Preferably all the units are secured to the supporting members by mechanical fixings passing through the outer sheets of the units outside the seals of the units.

The glass assembly may be a wall assembly of a building in which each of the sealed multiple glazing units of the planar array is mechanically secured at its corners, with the whole outer edge of the outer sheet of that unit sealed edge-to-edge with the edges of the outer sheets of adjacent units.

In a preferred embodiment each unit is a multiple glazing unit which is secured to the supporting members by bolts whose heads are countersunk into the outer face of the unit outside the seal of the unit.

Usually the units are double glazing units, and the inner sheet of each unit is inset from the outer sheet to provide a stepped construction with the outer sheet forming flanges extending beyond the inner sheet, and the units are secured to the supporting members by mechanical fixings passing through said flanges.

Preferably the units are rectangular with the inner sheets inset at the corners only with the mechanical fixings passing through the flanges formed by the outer sheets at the corners of the units.

Each corner of each unit may be flexibly secured to a bracket which is fixed to a supporting mullion or transom.

Each bracket for securing adjacent co-planar units may be in the form of an isosceles triangle which fits into inset cut-off corners of two adjoining units, and to which bracket the outer sheets of those adjoining units are secured.

Each of the edges of the equal sides of the triangular bracket may carry a cushioning edge strip of plastics material against which strip rest inset edges of the inner sheets of the adjoining units.

The supporting members may be metal or glass mullions or transoms of a building structure.

Further the invention provides, for use in such a glass assembly, a sealed multiple glazing unit comprising flat glass sheets, with holes through the outer glass sheet outside the seal of the unit for mechanical fixing to supporting members without obstructing the edge of the outer glass sheet of the unit.

Preferably the sealed multiple glazing unit is a double glazing unit whose inner sheet is inset from the outer sheet at least at two locations on opposite margins of the outer sheet with the outer sheet forming flanges at those locations, which flanges extend beyond the edges of the inner sheet, with fixing holes in those flanges.

The unit may be rectangular and has the inner sheet inset at the corners only so that the outer sheet forms a flange at each corner which corner flanges have fixing holes.

In the preferred embodiment each corner of the inner sheet is cut-off to expose a triangular region of the inner face of the outer sheet.

Preferably the fixing holes in the flanges are countersunk on the outside.

BRIEF DESCRIPTION OF THE DRAWINGS

Some embodiments of the invention will now be described, by way of example, with reference to the accompanying drawings, in which.

DETAILED DESCRIPTION

Figure 1:
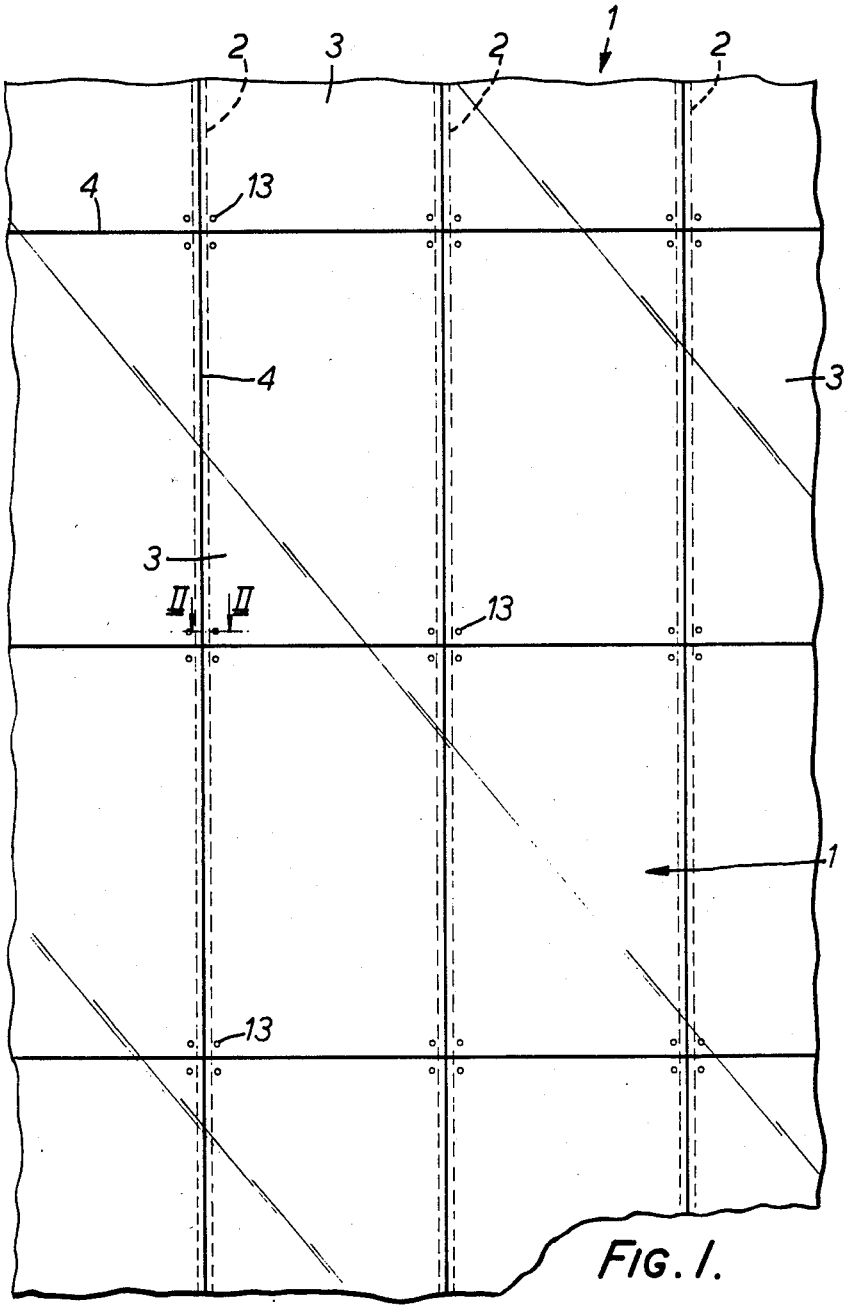
FIG. 1 is an elevation of the outside of a glass wall assembly constructed according to the invention.

FIG. 1 illustrates a glass wall assembly according to the invention comprising a planar array of sealed multiple glazing units 1 which are mechanically secured to supporting members 2 behind the wall, which are a part of a structural framework to which the wall assembly is secured. The outer sheets 3 of the multiple glazing units are supported edge-to-edge but leaving between adjacent edges a small gap which is sealed with a silicone sealant as indicated at 4. This silicone seal is shown more clearly in FIG. 2.

Figure 2:
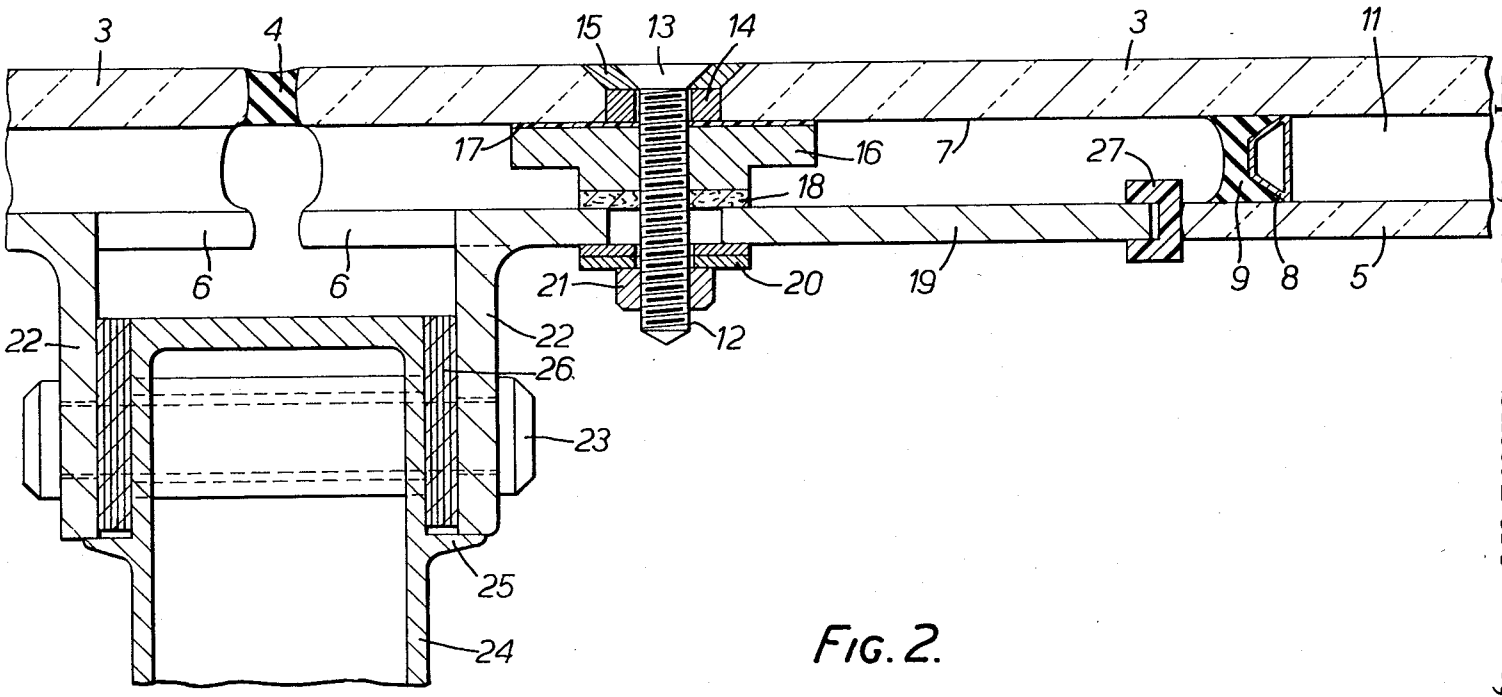
FIG. 2 is a section on line II—II of FIG. 1.
Figure 4:
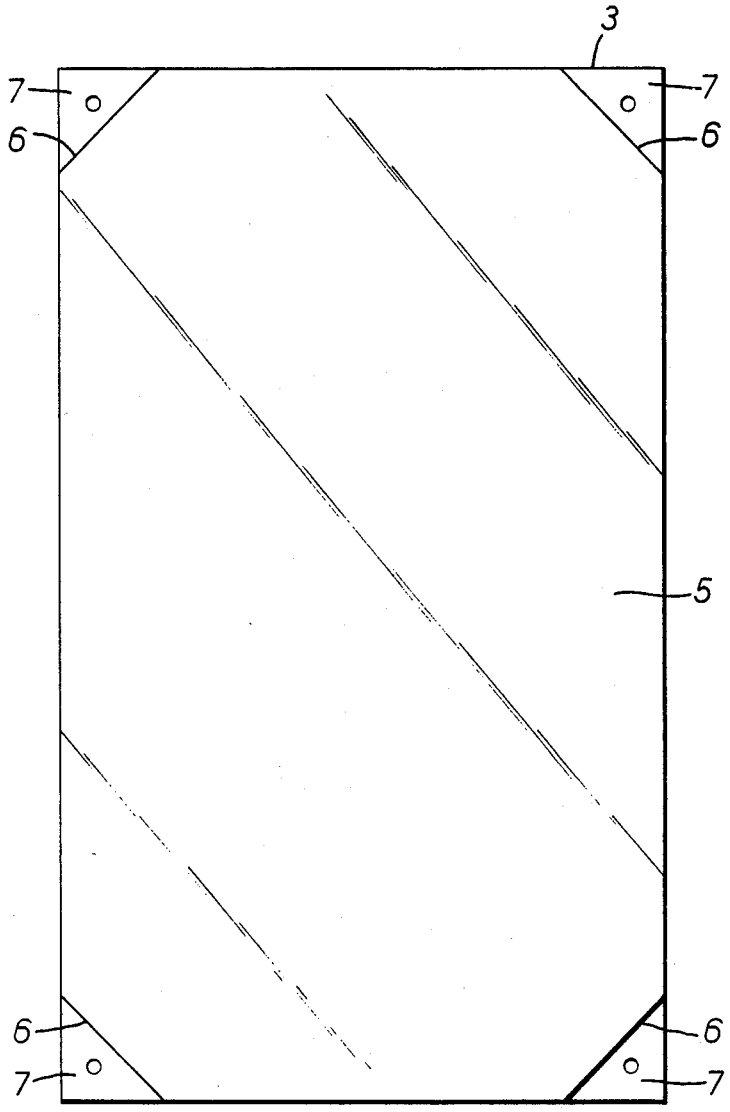
FIG. 4 is a rear elevation of a double glazing unit with stepped corners according to the invention.

Each of the multiple glazing units 1 is, in this embodiment, a double glazing unit comprising two opposed spaced sheets, namely an outer sheet 3 and an inner sheet 5, with a seal between them to prevent ingress of water vapour into the space between the sheets, as illustrated in FIG. 2. As shown in FIG. 1 the outer pane of each unit is of complete rectangular form, and as shown in FIG. 4 each corner of the inner sheet 5 is cut-off as indicated at 6 to expose a triangular flange region 7 of the outer sheet 3. The two sheets 3 and 5 of the double glazing unit are spaced apart by an aluminium spacer 8 of conventional cross section and secured to the spacer 8 by a sealant 9, for example a silicone sealant, as shown in FIG. 2. The spacer 8 is shaped to conform to the outline of the inner sheet 5, and has angled corners 10 which conform to the shape of the cut-off corners 6 of the inner sheet 5. There is thus a substantially peripheral seal between the sheets defining a sealed gas space 11 therewith.

This provides a stepped configuration at each corner of the double glazing unit as illustrated in FIG. 2, with the inner sheet of each unit inset from the outer sheet with the outer sheet forming the flanges 7 extending beyond the inner sheet to permit the unit to be flexibly secured to supporting members by mechanical fixings passing through the flanges 7 at each corner.

The glass sheets 3 and 5 of each double glazing unit may be annealed or toughened. In the embodiment illustrated the outer sheet 3 is 10 mm thick, the inner sheet 5 is 6 mm thick, there is a 14 mm sealed interspace 11 between the sheets, and there is an 8 mm gap between the edges of the outer sheets of adjacent units.

Each corner of the outer sheet 3 is drilled with a hole which is countersunk from the outside face. When toughened sheets are used this is done before toughening. This permits each corner of the outer sheet to be secured by means of a bolt 12 whose head 13 fits flush into a bush 14 in the countersunk hole. A tapered washer 15 is provided between the bolt head 13 and the bush 14 to spread the load on the bush. An aluminium spacer 16 is threaded onto the bolt 12 with a gasket 17 also threaded on the bolt between the spacer 16 and the inner face of the corner flange 7 of the sheet. A fibre washer 18 is then threaded onto the bolt and bears against the spacer 16.

Figure 3:
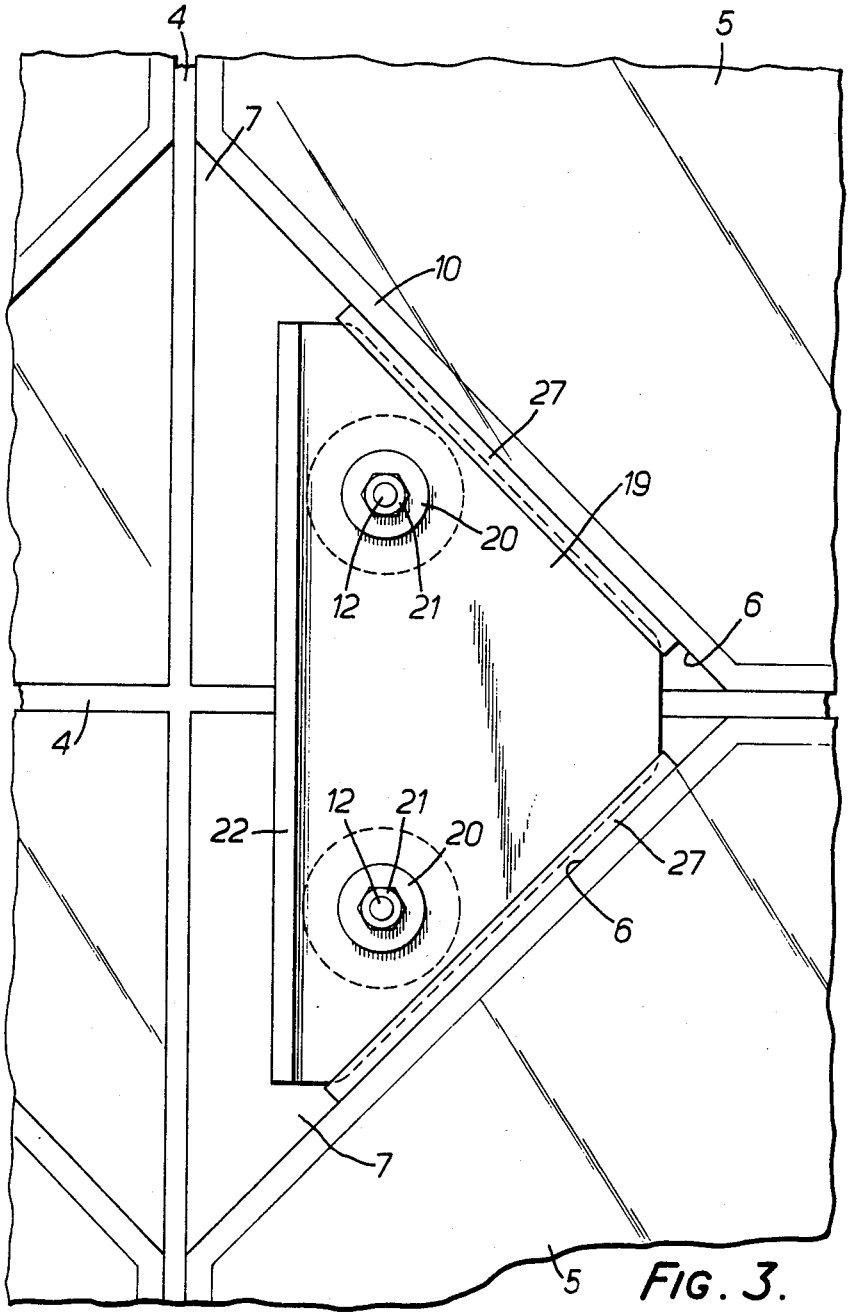
FIG. 3 is a rear elevation of the junction of corners of four multiple glazing units in the glass wall assembly of FIG. 1, omitting detail of the mullion to which the glazing units are secured.

The bolt 12 passes through a hole in an aluminium bracket 19, also illustrated in FIG. 3, which is in the form of an isosceles triangle, with truncated corners, which fits into the inset cut-off corners 6 of two adjoining double glazing units, and washers 20 and a nut 21 are tightened on to the bolt. Both corners are secured to the bracket in the same way.

The base 22 of the bracket 19 is secured by a stainless steel through-bolt 23 to a vertical aluminium mullion 24 which is a structural supporting member for the glass wall assembly. For positioning the bracket 19, the base 22 bears against a flange 25, and there is a shim 26 between the base 22 of the bracket and the mullion 24. The bolt 23 passes through the mullion and secures the base 22 of a similar bracket at the other side of the mullion, that other bracket providing mechanical fixing for an adjoining unit. The outer sheets 3 of the units are sealed edge-to-edge by silicone sealant 4.

Each of the edges of the equal sides of the bracket 19 carries a cushioning edge strip 27 of plastics material, for example "Neoprene", against which strip the inset edges 6 of the inner sheets of the adjoining units rest. The strips 27 at the lower corners help to distribute the transmission of the weight of the unit to the fixing brackets, and the strips at the upper corners prevent glass-to-metal contact which might damage the glass.

This arrangement provides a flexible fixing for each corner of each double glazing unit which is sufficiently flexible to accomodate any thermal contraction and expansion and to permit flexing of the double glazing unit due to changes of wind pressure, while spreading the weight load of each unit on the brackets without any obstruction to the edge of the outer sheet of the unit so that the advantageous fixing of the multiple glazing units does not detract from the uninterrupted planar appearance of the outside of the assembly.

Figure 5:
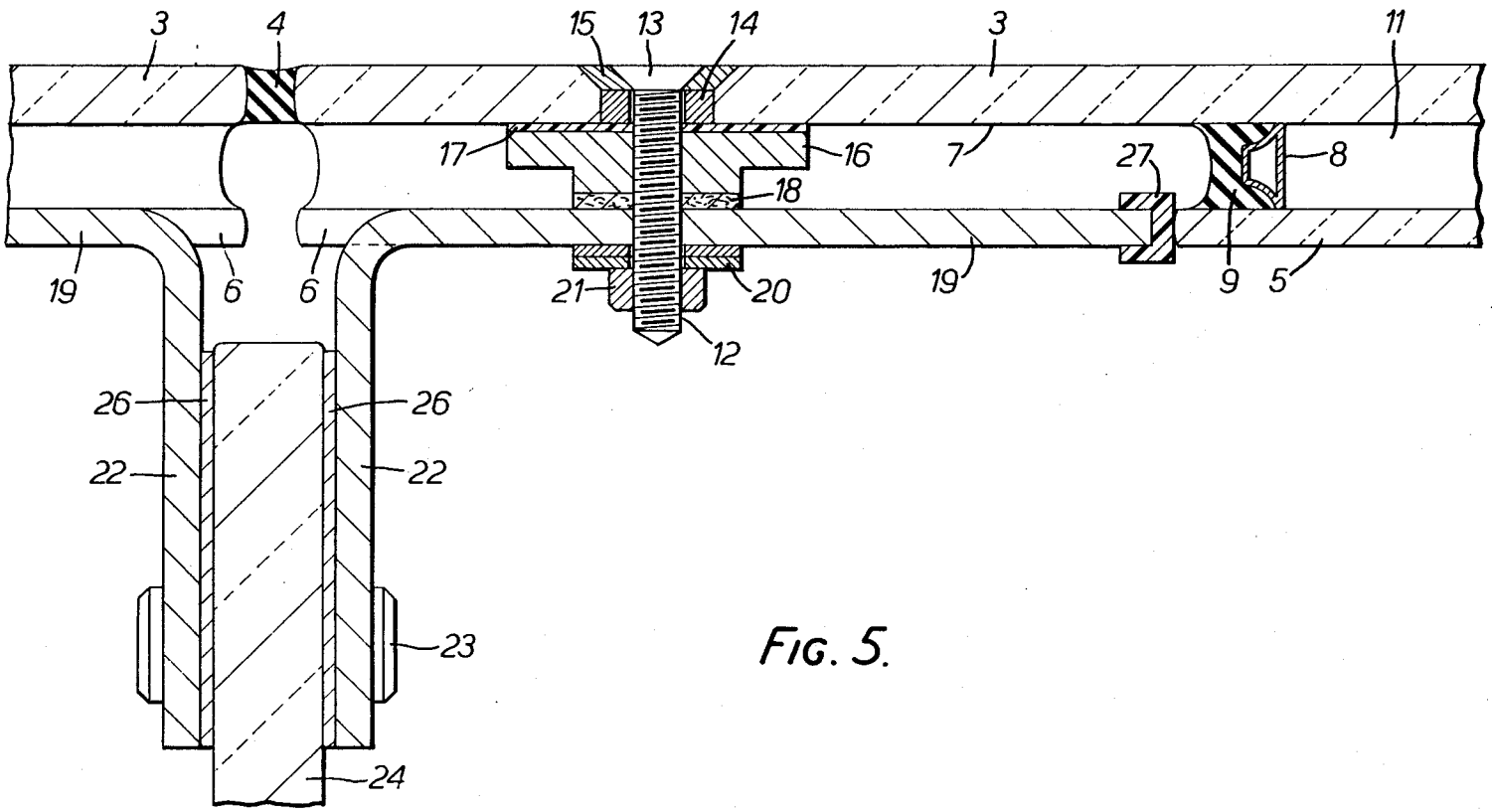
FIG. 5 is a sectional view similar to FIG. 2 of a glass wall assembly in which the multiple glazing units are secured to supporting glass members.

FIG. 5 illustrates another glass wall assembly in which the construction and mechanical fixing of the sealed double glazing units in their edge-to-edge sealed disposition is the same as just described but the units are fixed by means of aluminium brackets 19 to a vertical fin 24 of toughened glass. The bases 22 of adjacent brackets bear against the fin 24 with shims 26 between the bases 22 of the brackets and the fin 24. The glass supporting fin 24 may for example be of toughened glass which is 19 mm thick.

The spacers 8 and 16, the brackets 19 and the mullions 24 may be made of another metal, for example mild steel.

The invention therefore provides a glass assembly which can be employed as a wall or a continuous rooflight, and which is of pleasing external appearance because of the uninterrupted planar abutment of the outer sheets of the glazing units edge-to-edge with only the countersunk heads of the fixing bolts and the sealing compound visible. The structural assembly embodies all the advantages of sealed multiple glazing units, particularly thermal and sound insulation. The nature of the corner fixing of the multiple glazing units ensures that a maximum possible area of the wall assembly is multiple-glazed.

Interlayers and special coatings may be employed in the construction of each multiple glazing unit in known manner, for example heat and light reflecting coatings. Usually such coatings are provided on the inner face of the outer sheet or the outer face of the inner sheet so that the coating is protected within the sealed interspace.

I claim:

1. A glass assembly comprising a planar array of sealed double glazing units, each unit comprising an outer sheet, an inner sheet which is inset from the outer sheet to provide a stepped construction with the outer sheet forming flanges extending beyond the inner sheet, and sealing means between the sheets defining a sealed gas space therewith, said flanges of the outer sheet extending outside the sealed gas space, the assembly further comprising mechanical fixings securing the units to supporting members, said mechanical fixings passing through said flanges outside the sealing means, and the outer sheets of the units being sealed edge-to-edge with the edges of the outer sheets of adjacent units.

2. An assembly according to claim 1, wherein the units are rectangular with the inner sheets inset at the corners only with the mechanical fixings passing through the flanges formed by the outer sheets at the corners of the units.

3. An assembly according to claim 2, wherein each corner of each unit is flexibly secured to a bracket which is fixed to a supporting mullion or transom.

4. An assembly according to claim 1, wherein the supporting members are metal or flass mullions or transoms.

5. A glass assembly comprising a planar array of sealed double glazing units wherein:

(a) each unit comprises an inner sheet, an outer sheet, and a seal between the sheets defining a sealed gas space therewith;

(b) the units are rectangular and the inner sheet of each unit is inset from the outer sheet at the corners only to provide a stepped construction with the outer sheet forming flanges extending beyond the inner sheet;

(c) each corner of each unit is flexibly secured to a bracket which is fixed to a supporting mullion or transom by a mechanical fixing passing through the flange formed by the outer sheet at that corner of the unit, which mechanical fixing is outside the seal of the unit;

(d) each said bracket is for securing adjacent coplanar units and is in the form of an isosceles triangle which fits into the inset cut-off corners of two adjoining units, and to which bracket the outer sheets of those adjoining units is secured; and (e) the outer sheets of the units are sealed edge-to-edge with the edges of the outer sheets of adjacent units.

6. An assembly according to claim 5, wherein each of the edges of the equal sides of the bracket carries a cushioning edge strip of plastics material against which strip rest inset edges of the inner sheets of the adjoining units.

7. A sealed double glazing unit for use in a glass assembly comprising a planar array of such units, which double glazing unit comprises an inner flat glass sheet and an outer flat glass sheet with the inner sheet inset from the outer sheet at least at two locations on opposite margins of the outer sheet with the outer sheet forming flanges at those locations which flanges extend beyond the edges of the inner sheet, and with fixing holes in those flanges which holes are outside the seal of the unit and are for mechanical fixing to supporting members without obstructing the edge of the outer glass sheet of the unit.

8. A unit according to claim 7, which is rectangular and has the inner sheet inset at the corners only so that the outer sheet forms a flange at each corner which corner flanges have fixing holes.

9. A unit according to claim 8, wherein each corner of the inner sheet is cut-off to expose a triangular region of the inner face of the outer sheet.

10. A unit according to claim 7, wherein the fixing holes in the flanges are countersunk on the outside.

* * * * *